US010661946B2

(12) United States Patent
Cleland

(10) Patent No.: US 10,661,946 B2
(45) Date of Patent: May 26, 2020

(54) WRAP AROUND FLUID DIRECTOR

(71) Applicant: Cleland Sales Corporation, Los Alamitos, CA (US)

(72) Inventor: James Cleland, Cyress, CA (US)

(73) Assignee: Cleland Sales Corporation, Los Alamitos, CA (US)

( * ) Notice: Subject to any disclaimer, the term of this patent is extended or adjusted under 35 U.S.C. 154(b) by 0 days.

(21) Appl. No.: 16/252,397

(22) Filed: Jan. 18, 2019

(65) Prior Publication Data

US 2019/0217992 A1 Jul. 18, 2019

Related U.S. Application Data

(60) Provisional application No. 62/618,738, filed on Jan. 18, 2018.

(51) Int. Cl.
*B65D 25/48* (2006.01)
*B65D 25/20* (2006.01)
*B67C 11/00* (2006.01)

(52) U.S. Cl.
CPC ..... *B65D 25/48* (2013.01); *B65D 25/20* (2013.01); *B67C 11/00* (2013.01)

(58) Field of Classification Search
CPC ..... B65D 25/48; B65D 25/20; B65D 5/74; B65D 5/746
USPC ..... 222/567, 570
See application file for complete search history.

(56) References Cited

U.S. PATENT DOCUMENTS 200,976 A * 3/1878 Campbell ..... A47J 36/08 210/469
280,515 A * 7/1883 Rhoads ..... B65D 25/44 222/567
1,165,285 A * 12/1915 Record ..... B65D 90/54 222/533
1,298,031 A * 3/1919 Fromhagen ..... B65D 25/48 222/569
1,965,356 A * 7/1934 Rittenhouse ..... B65D 25/48 222/460
2,071,638 A * 2/1937 Lauterbach ..... B65D 25/48 222/569
2,200,642 A * 5/1940 Shell ..... B67C 11/02 222/51

(Continued)

*Primary Examiner* — Benjamin R Shaw
(74) *Attorney, Agent, or Firm* — Fish IP Law, LLP

(57) ABSTRACT

Systems, methods, and devices to improve pouring large or unwieldy containers are disclosed. A band couples about or proximal to a rim of a container. In some embodiments, bands are sized and dimensioned to rigidly fit containers with specific shapes and dimensions, though universal or nearly universal bands that flexibly conform to the shape of any container are further contemplated. The band secures a spout portion to a pouring edge of the container. The spout portion includes a shelf extending from the pouring edge and bounded by two side walls having splash guards. The side walls and splash guards serve to funnel food stuffs or liquids towards a receptacle when the container is tipped toward the pouring edge. The spout region further includes an overflow shelf to prevent food stuffs or liquids from spilling out of the container by accident or during rapid pouring. A handle can be further attached to the band to aid a user in lifting and pouring the container.

8 Claims, 5 Drawing Sheets

(56) References Cited

U.S. PATENT DOCUMENTS 2,315,250 A * 3/1943 Eilers ..... B65D 25/48 222/567
2,471,189 A * 5/1949 Bartels ..... B65D 25/48 222/189.07
2,520,549 A * 8/1950 Jacobsen ..... B65D 25/48 222/460
2,550,568 A * 4/1951 Kersh ..... A47G 19/2272 215/11.1
2,580,811 A * 1/1952 Martinsen ..... B65D 25/48 222/460
2,735,594 A * 2/1956 Carnes ..... B65D 5/746 222/567
2,765,966 A * 10/1956 Davis ..... B65D 25/48 222/570
2,786,614 A * 3/1957 Giusto ..... B65D 25/48 222/570
2,817,464 A * 12/1957 Schugeld ..... B65D 25/48 222/465.1
2,849,158 A * 8/1958 Hopla ..... B65D 25/48 222/189.07
3,159,321 A * 12/1964 Severino ..... B65D 25/48 222/570
3,221,955 A * 12/1965 Banaszak ..... B65D 25/48 222/570
3,239,113 A * 3/1966 Knize ..... B65D 47/121 222/569
3,400,867 A * 9/1968 Giannone ..... B44D 3/12 222/570
3,679,103 A * 7/1972 Chmela ..... A45F 5/10 222/192
3,695,488 A * 10/1972 Olsson ..... B65D 25/48 222/570
3,853,249 A * 12/1974 Weir, Jr. ..... B65D 25/48 222/570
4,203,537 A * 5/1980 McAlister ..... B44D 3/128 220/675
4,299,340 A * 11/1981 Hrytzak ..... B65D 25/48 222/189.07
4,702,395 A * 10/1987 Nitsch ..... B44D 3/123 220/318
4,911,319 A * 3/1990 DeJean ..... B44D 3/128 220/700
5,195,662 A * 3/1993 Neff ..... B44D 3/128 220/700
5,388,715 A * 2/1995 Schwindt ..... B44D 3/127 220/229
5,505,347 A * 4/1996 Roma ..... B65D 25/48 222/570
D456,259 S * 4/2002 Groenewald ..... D9/447
6,908,089 B1 * 6/2005 Stark ..... B62B 1/20 222/461
7,360,673 B2 * 4/2008 Abrahams ..... A47J 36/14 220/571.1
8,757,453 B1 * 6/2014 Olsson ..... B65D 25/48 220/700
10,112,738 B2 * 10/2018 McCarthy ..... B65D 23/065
2012/0168467 A1 * 7/2012 Murphy ..... E04G 23/0203 222/465.1
2015/0266337 A1 * 9/2015 Abernethy, Jr. ..... B44D 3/128 222/570

* cited by examiner

WRAP AROUND FLUID DIRECTOR

CROSS REFERENCE TO RELATED APPLICATIONS

This application claims priority U.S. Provisional Application No. 62/618,738, filed Jan. 18, 2018. This and all other extrinsic materials discussed herein are incorporated by reference in their entirety.

FIELD OF THE INVENTION

The field of the invention is food service accessories.

BACKGROUND

It is generally advantageous in the food service industry, to serve customers at a high turnover rate. However, increased customer traffic causes increased depletion of foods and beverages. This is further complicated for foods and beverages that are served in high volumes, such as through beverage dispensers or buffet food trays. Such high volume food and beverage service requires high volume replenishment, using clean devices and equipment that are preferably durable enough for repeat use.

One approach for providing high volume replenishment of food and beverage receptacles is to refill the receptacles from similarly high volume containers, preferably using rolling trays or other motive devices. For example, it is known to use high quality, durable, large volume containers such as those available from Cambro® to transport and replenish food and beverage stuffs. While such equipment may prove useful for transporting replacement food or beverage stuffs to the dispensers, large volume containers are clumsy, and when full are quite heavy. This problem is further compounded when the transport containers hold liquids that tends to slosh around, and especially when the dispensers to be replenished are not easily accessible (e.g., having shoulder level or higher refill access).

The background description includes information that may be useful in understanding the present invention. It is not an admission that any of the information provided herein is prior art or relevant to the presently claimed invention, or that any publication specifically or implicitly referenced is prior art.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for improved devices that facilitate and simplify the safe and clean transfer of beverage and food stuffs from high volume containers into dispensers, particularly where the beverage or food stuffs are liquid, or where the refill access on the receptacle is difficult to reach.

SUMMARY OF THE INVENTION

The inventive subject matter provides apparatus, systems and methods in which high volume containers are adapted to enable easier pouring of beverage or food stuffs into a dispenser or another receptacle.

Various objects, features, aspects and advantages of the inventive subject matter will become more apparent from the following detailed description of preferred embodiments, along with the accompanying drawing figures in which like numerals represent like components.

The inventive subject matter contemplates a pouring attachment to be attached to a transfer vessel. The pouring attachment includes a band, sized and dimensioned to releasably couple to a rim of the vessel. It is contemplated that devices of the inventive subject matter can be used with vessels of various shapes (e.g., squared rim, rectangular rim, rhomboid rim, a triangular rim, a circular rim, an oval rim, etc). For example, it is contemplated that the bands of such devices have the same or substantially the same shape as the vessel or rim of the vessel. A spout is coupled to the band, and has a shelf (preferably substantially horizontal when the transfer vessel is vertical) that extends away from the band. The shelf is partially bounded by a first and a second edge piece, which extend laterally away from the band. In some embodiments the rim of the vessel has a perimeter of between 28 inches and 60 inches, though the perimeter can be as little as 20 inches or as much as 100 inches, while the band of the device has a perimeter roughly equivalent to that of the vessel rim.

The band is preferably sized and dimensioned to releasably couple to the vessel at a position between (a) the rim and (b) a handle of the transfer vessel. When the pouring attachment is coupled to the transfer vessel, it is preferred that a portion of the shelf adjacent to the vessel is substantially flush with the rim of the vessel. It should be appreciated that the shelf extends away from the rim of the transfer vessel. The band can be made at least partially from metal or an elastic material, and can further include other components such as a tensioner (e.g., clasp, threaded screw, ratchet, clamp, etc) or a negative pressure coupling (e.g., suction cup, etc).

For example, where the band is not in the shape of the vessel or rim of the vessel, it is contemplated that the band is made of elastic or flexible material, such that the band conforms to the shape of the vessel or vessel rim. It should be appreciated that such flexible bands capable of conforming to the shape of different vessels or vessel rims would be considered universally applicable to a plurality of vessels with different shapes. Moreover, where the band has a perimeter greater than the perimeter of the vessel or vessel rim (e.g., 5% greater, or 10%, 15%, 20%, 25%, or 50% greater), a tensioner device with a ratcheting or synching mechanism can be used to take up excessive slack in the band and otherwise tension the band about the vessel or vessel rim.

It is preferred that the spout and the band are securely, but releasably, coupled together. For example, in some embodiments no less than 360 N (Newtons) of force can decouple the spout from the band. Likewise, no less than 360 N of force can decouple the band from the transfer vessel, while as little as 10 N of force can be applied in a selected fashion (e.g., open clasp, depress button, etc) to selectively decouple the band from the transfer vessel. Thus, it should be appreciated that both the spout and band, as well as the band and transfer vessel, remain coupled during normal use of the pouring attachment, for example when pouring liquid from the transfer vessel into a dispenser or other receptacle.

Pouring attachments of the inventive subject matter can releasably couple about the rim of a transfer vessel in (1) a first configuration where the spout of the attachment at least partially overlaps a handle of the transfer vessel or (2) a second configuration where a handle of the transfer vessel is not overlapped by the spout of the attachment. Viewed from another perspective, the attachment can be adaptably coupled to a transfer vessel to allow for the easiest carrying or manipulation of the transfer vessel, for example making handles or other parts of the transfer vessel easier to access to enable pouring, etc.

The inventive subject matter also contemplates fluid directors. In preferred embodiments, fluid directors have a strap with a length, and a spout coupled to the strap. The spout has a shelf that extends from both (1) a pouring section of the strap (e.g., a portion of the strap where fluid is expected to flow over, etc) and (2) a section adjacent to the pouring section (e.g., a portion of the strap where fluid is not expected to flow over, may flow over accidentally, etc). The shelf is partially bounded by a first and a second edge.

The strap can be made at least partially from metal or an elastic material, and can further include other components such as a tensioner (e.g., clasp, threaded screw, ratchet, clamp, cinch, lever, etc) or a negative pressure coupling (e.g., suction cup, etc). In some embodiments, a summed length of the pouring section and the section adjacent to the pouring section of the strap is less than half of the length of the strap. Viewed from another perspective, in some embodiments the shelf extends away from the strap along less than half the length of the strap.

It is preferred that the first edge (or both edges) extends perpendicularly from the shelf, but edges can also extend in at an angle, slope, curvature, or irregularly from the shelf. Preferably, the first and second edges form a channel along the bound of the shelf to direct fluid toward a pouring edge of the shelf. In some embodiments a gap between the first and second edges defines a pouring edge of the shelf. A length of the shelf extending from the strap to a pouring edge of the shelf is preferably no more than 30% of the length of the strap. Likewise, a height of the first or second edges is preferably no more than 10% of the length of the strap.

It is contemplated that the length of the strap is no less than 28 inches and no more than 60 inches, but it should be appreciated the strap can be of a length required to bound (at least partially) or otherwise couple to a transfer vessel near its rim.

Fluid directors and pouring or attachments of the inventive subject optionally include a handle attached to the strap or band at first and second points. In preferred embodiments, the handle is attached to the strap or band such that the first and second points substantially oppose each other when the strap or band is coupled to a vessel. More preferably, the handle attaches at points on the strap or band such that, when the strap or band is coupled to a vessel, lifting the vessel via the handle maintains the vessel in a substantially level orientation.

DETAILED DESCRIPTION

The inventive subject matter contemplates apparatus, systems, and methods in which high volume containers are adapted to enable easier pouring of beverage or food stuffs into a dispenser or another receptacle.

Figure 1:
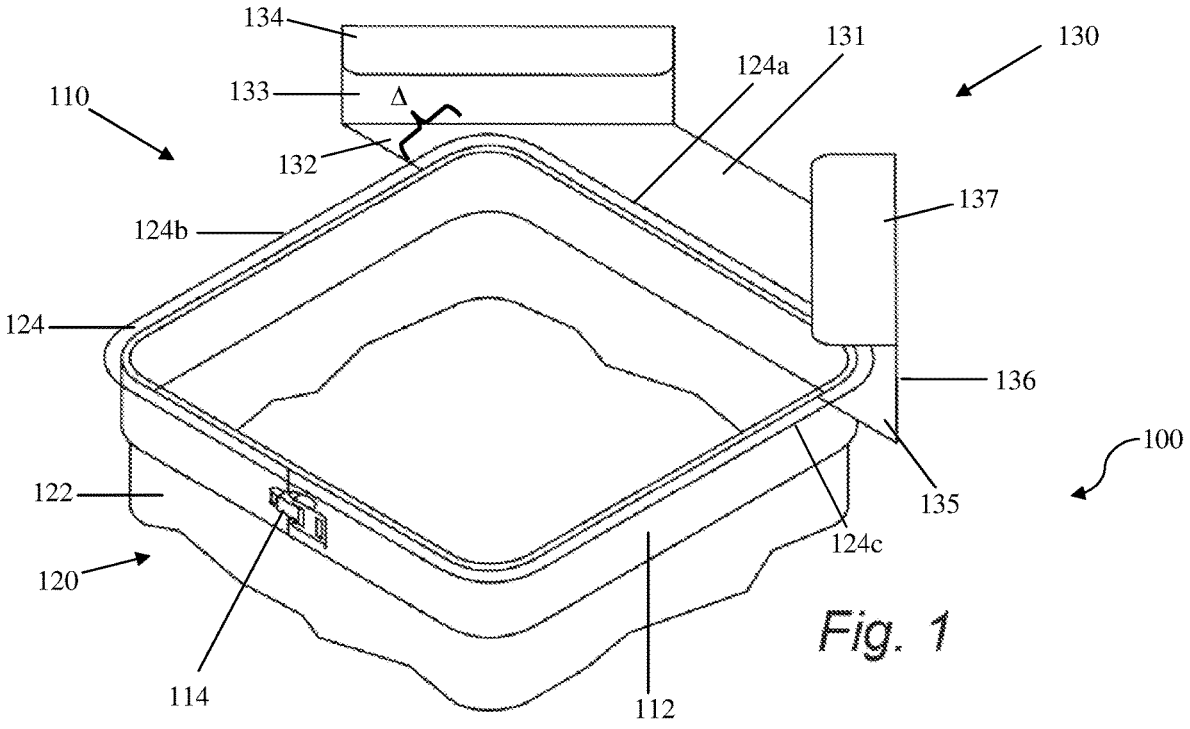
FIG. 1 depicts a perspective view of a first pouring attachment of the inventive subject matter.
Figure 2:
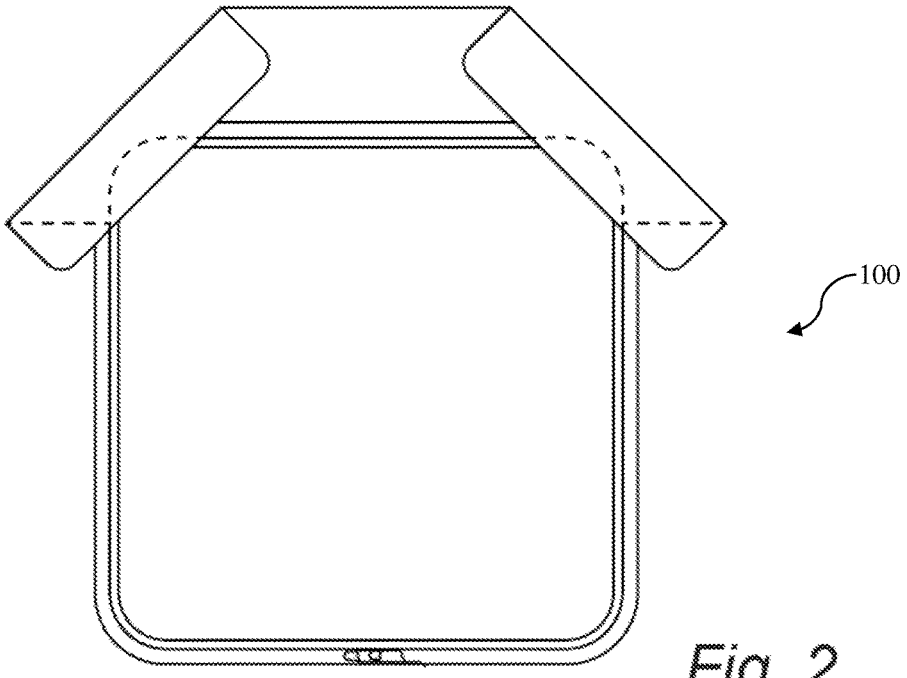
FIG. 2 depicts a top plan view of the first pouring attachment of the inventive subject matter.
Figure 3:
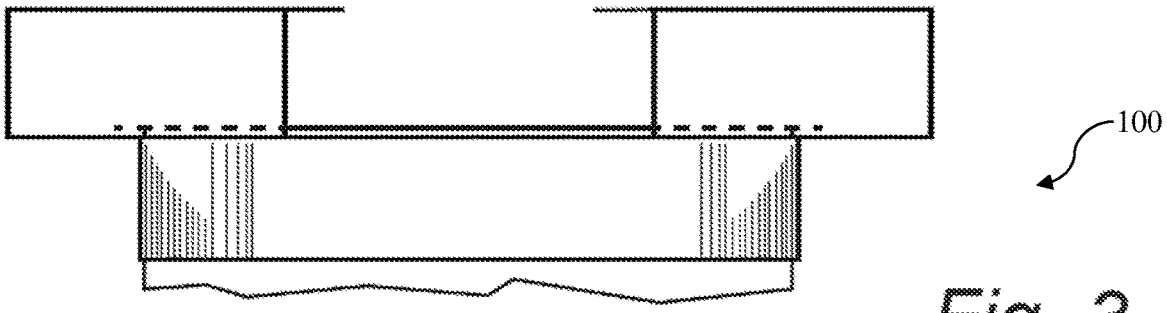
FIG. 3 depicts a front elevation view of the first pouring attachment of the inventive subject matter.
Figure 4:
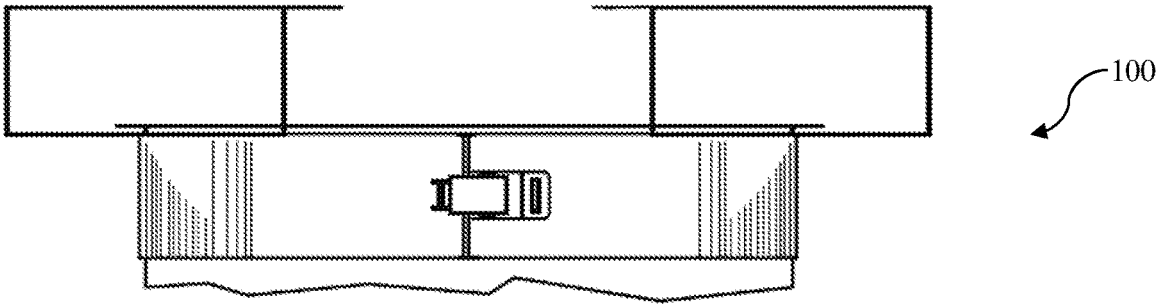
FIG. 4 depicts a rear elevation view of the first pouring attachment of the inventive subject matter.
Figure 5:
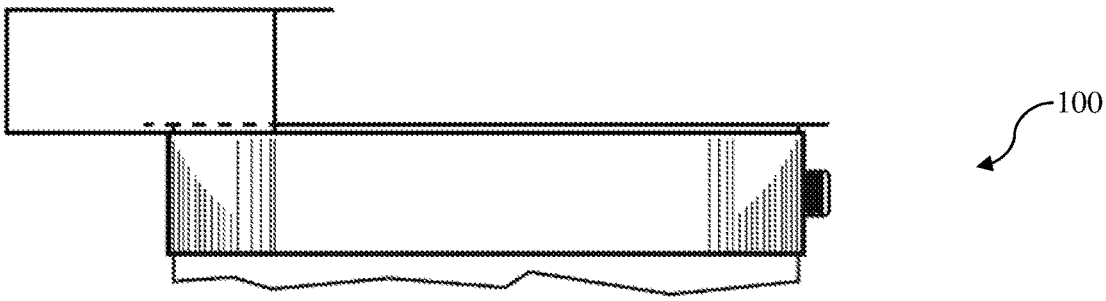
FIG. 5 depicts a left elevation view of the first pouring attachment of the inventive subject matter.
Figure 6:
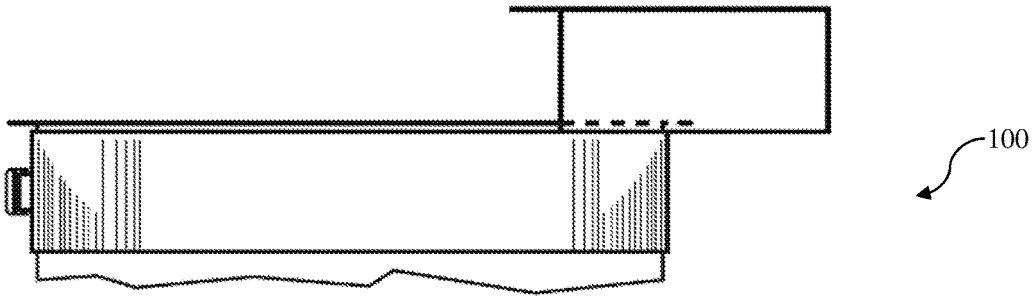
FIG. 6 depicts a right elevation view of the first pouring attachment of the inventive subject matter.

FIG. 1 depicts a perspective view of assembly 100, which includes pouring attachment 110 coupled to container 120. Pouring attachment 110 includes band 112, clasp 114, and spout portion 130. Band 112 is wrapped around outer surface 122 of container 120 proximal to rim 124 of container 120. It is preferred that band 112 abuts or is plumb to rim 124, but band 112 can wrap around container 120 in a region that is close to the rim, for example within 0.5, 1, 1.5, or 2 inches from rim 124.

Spout portion 130 includes shelf 131 that extends away from pouring edge 124*a* of container 120. Shelf 131 is bounded on two sides by side walls 133 and 136. Side walls 133 and 136 are further bounded by splash guards 134 and 137, respectively. Splash guards 134 and 137 extend from side walls 133 and 136 (respectively) at roughly 90° and are substantially parallel with shelf 131, though it is contemplated that splash guards 134 and 137 can extend obtusely (e.g., 100°, 110°, 120°, 130°, etc) from side walls 133 and 136 (respectively), or can extend in a curved fashion from the side walls.

It should be noted spout portion 130 further includes overflow shelves 132 and 135 that extend a distance Δ behind pouring edge 124*a*, with accompanying extensions of side walls 133 and 136 and splash guards 134 and 137, respectively. It is contemplated that overflow shelves 132 and 135 serve to prevent liquid or food stuffs from spilling over non-pouring edges 124*b* and 124*c* when container 120 is tipped to pour out its contents. In some embodiments, overflow shelves 132 and 135 extend a distance Δ that is less than 5% the length of pouring edge 124*a*, though it is contemplated that distance Δ can be as much as 10%, 15%, 20%, 25%, or 30% the length of pouring edge 124*a*, or alternatively as much as 5%, 10%, 15%, 20%, 25%, or 30% the length of non-pouring edge 124*b* or 124*c*.

In the present embodiment, band 112 is typically metallic, and has a length approximately equivalent to the perimeter of container 120, but can be as much as 1%, 2%, 3%, 4%, or 5% longer than the perimeter of container 120. However, it is contemplated that band 112 can be made out of other suitable materials, for example rubber or elastic material that can flexible wrap about containers of various sizes and dimensions and stretched tight to provide a strong coupling with the container. Clasp 114 preferably acts to fasten band 112 securely about container 120, bringing band 112 taut against outer surface 1222 of the container, whether band 112 is metallic or elastic.

FIGS. 2-6 provide further depictions of assembly 100, with elements as described above.

Figure 7:
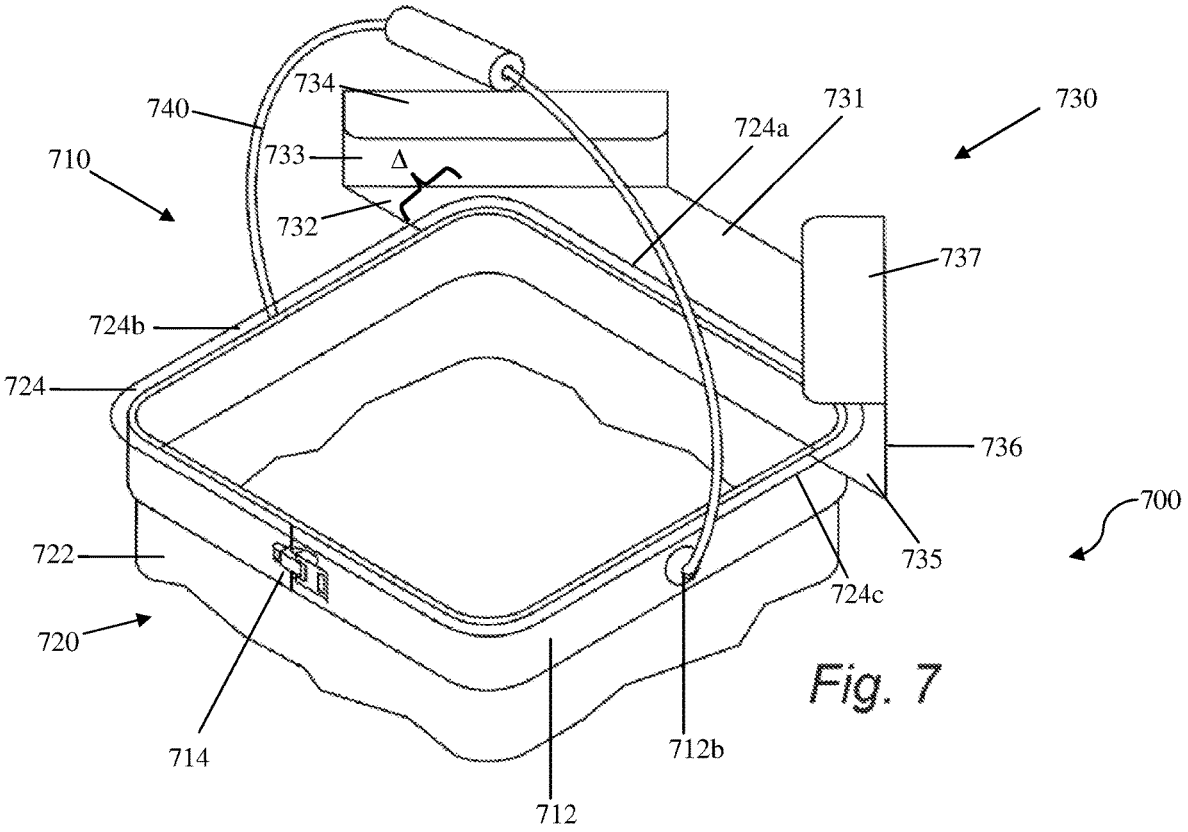
FIG. 7 depicts a perspective view of a second pouring attachment of the inventive subject matter.

FIG. 7 depicts an additional assembly 700 including pouring attachment 710 of the inventive subject matter.

Figure 8:
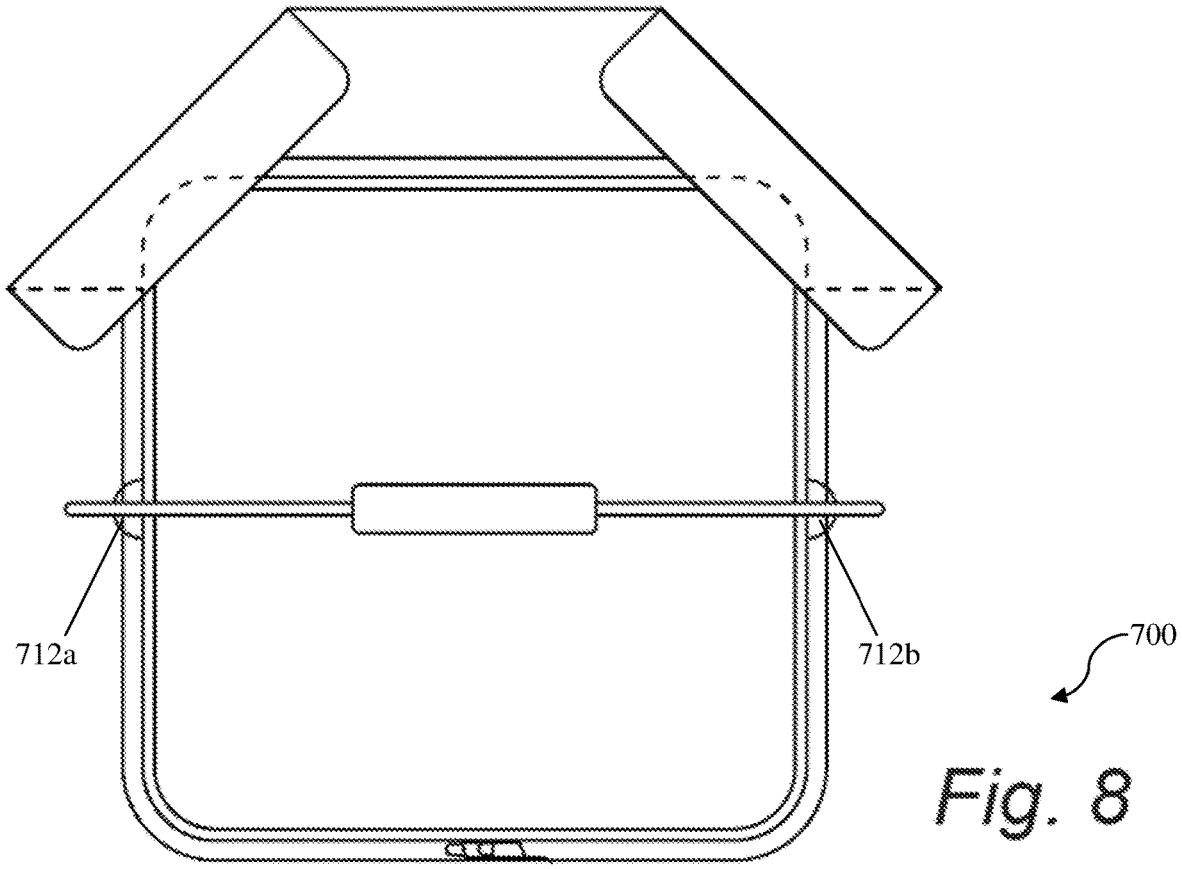
FIG. 8 depicts a top plan view of the second pouring attachment of the inventive subject matter.
Figure 9:
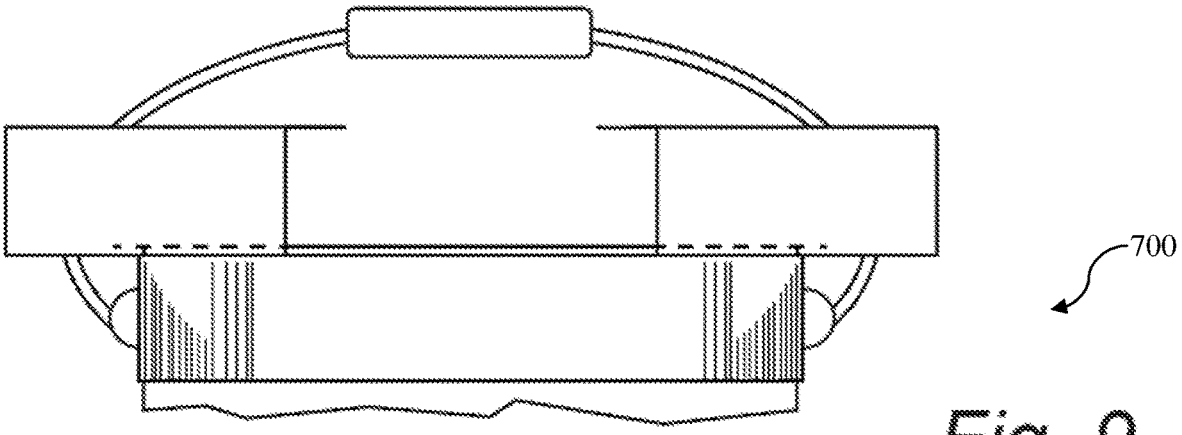
FIG. 9 depicts a front elevation view of the second pouring attachment of the inventive subject matter.
Figure 10:
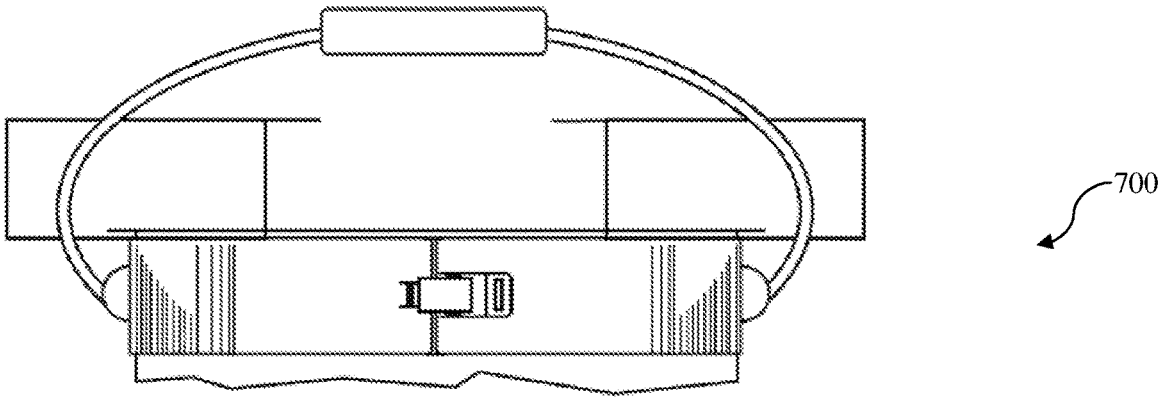
FIG. 10 depicts a rear elevation view of the second pouring attachment of the inventive subject matter.
Figure 11:
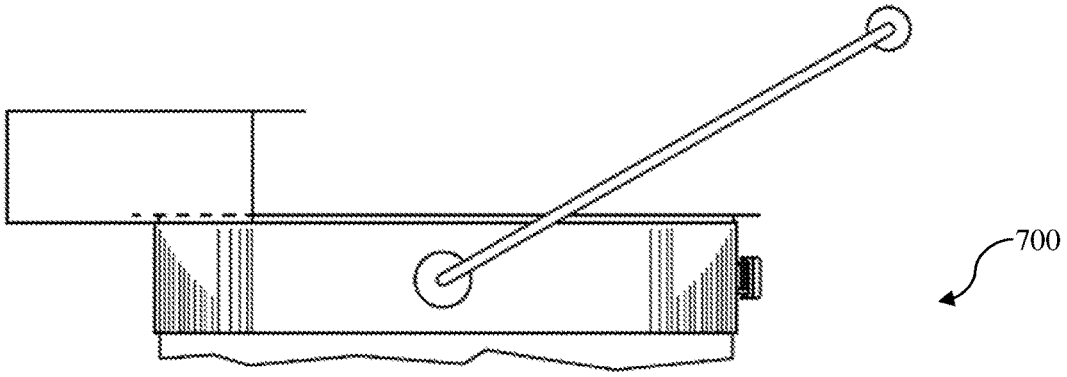
FIG. 11 depicts a left elevation view of the second pouring attachment of the inventive subject matter.
Figure 12:
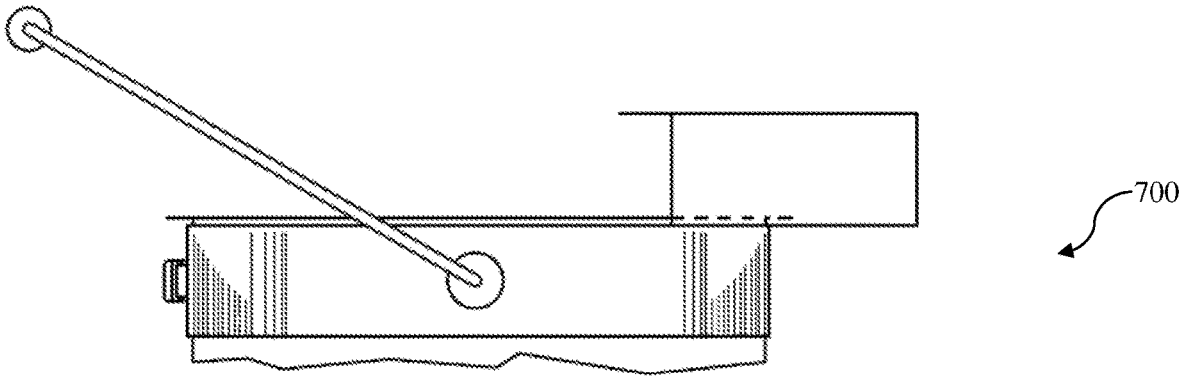
FIG. 12 depicts a right elevation view of the second pouring attachment of the inventive subject matter.

Elements similarly numbered in FIG. 7 are as described in FIG. 1. It should be noted that pouring attachment 710 further includes handle 740 coupled with band 712 at attachment points 712*a* (not pictured, see FIG. 8) and 712*b*. Handle 740 is used to aid in lifting, carrying, tipping, and pouring container 720. As depicted, attachment points 712*a* and 712*b* are preferably along opposite median points of a container, such that the container maintains a level balance when lifted by handle 740. However, it is contemplated that attachment points 712*a* and 712*b* can be located at portions of band 712 that will result in a tipping bias for a container when lifted by handle 740. For example, attachment points 712*a* and 712*b* can be positioned further from pouring edge 724*a*, resulting in bias for container 720 to tip toward pouring edge 724*a* when lifted by handle 740, thereby aiding a user in pouring contents out of container 720. Likewise, it is contemplated that band 712 can include a plurality of attachment points along its lengths, allowing handle 740 to attach at user selected points on band 712. It is contemplated that such customizable attachabiliy of handle 740 to belt 712 is particularly useful in embodiments of the inventive subject matter where a single band can couple to containers of different sizes, shapes, and dimensions.

FIGS. 8-12 provide further depictions of assembly 700, with elements as described above.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The following description includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A pouring attachment comprising:

a band sized and dimensioned to releasably couple to a rim of a transfer vessel; and a spout mechanically coupled to the band, wherein the spout comprises a shelf extending away from the band, and wherein the shelf is partially bounded by a first and a second edge piece extending laterally away from the band, and the shelf further comprises a pouring section of the shelf extending from a pouring section of the band and an overflow section of the shelf extending from a non-pouring section of the band; and a splash guard extending from the first edge piece.

2. The pouring attachment of claim 1, wherein the rim has a perimeter of between 28 inches and 60 inches.

3. The pouring attachment of claim 1, wherein the band is sized and dimensioned to releasably couple between the rim and a handle of the transfer vessel.

4. The pouring attachment of claim 1, wherein the splash guard extends from the first edge piece at one of substantially a 90° angle, an obtuse angle, or as a curvature extending generally toward the second edge.

5. The pouring attachment of claim 1, wherein the pouring section of the band is substantially straight.

6. The pouring attachment of claim 1, wherein the non-pouring section of the band adjacent to the pouring section is substantially perpendicular to the pouring section.

7. The pouring attachment of claim 1, wherein the band releasably couples to the rim of the transfer vessel in (1) a first configuration where the spout at least partially overlaps a handle of the transfer vessel or (2) a second configuration where a handle of the transfer vessel is not overlapped by the spout.

8. The pouring attachment of claim 1, further comprising a handle coupled to a first and a second portion of the band, wherein the first and the second portions of the band substantially oppose each other when the pouring attachment is coupled to the rim of the transfer vessel.

* * * * *